US008123335B2

(12) United States Patent
Kanda et al.

(10) Patent No.: US 8,123,335 B2
(45) Date of Patent: Feb. 28, 2012

(54) LIQUID DROPLET EJECTING HEAD AND LIQUID DROPLET EJECTING APPARATUS

(75) Inventors: Torahiko Kanda, Kanagawa (JP); Kenichi Ohno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 380 days.

(21) Appl. No.: 12/469,369

(22) Filed: May 20, 2009

(65) Prior Publication Data

US 2010/0156995 A1 Jun. 24, 2010

(30) Foreign Application Priority Data

Dec. 18, 2008 (JP) ..... 2008-322133

(51) Int. Cl.
*B41J 2/04* (2006.01)
*B41J 2/05* (2006.01)

(52) U.S. Cl. ..... 347/54; 347/65

(58) Field of Classification Search ..... 347/20, 347/40, 54, 56, 65
See application file for complete search history.

(56) References Cited

U.S. PATENT DOCUMENTS

| | | | | |
|---|---|---|---|---|
| 4,336,544 | A | 6/1982 | Donald et al. | |
| 5,835,113 | A | 11/1998 | Hirahara et al. | |
| 5,909,230 | A | 6/1999 | Choi et al. | |
| 5,988,799 | A | 11/1999 | Abe et al. | |
| 6,003,978 | A | 12/1999 | Asakawa et al. | |
| 6,036,105 | A | 3/2000 | Sanada et al. | |
| 6,142,613 | A | 11/2000 | Asakawa et al. | |
| 6,644,786 | B1 | 11/2003 | Lebens | |
| 6,991,322 | B2 * | 1/2006 | Silverbrook | 347/62 |
| 7,517,054 | B2 | 4/2009 | Kanda | |
| 2002/0085064 | A1 | 7/2002 | Nakata et al. | |
| 2002/0118256 | A1 | 8/2002 | Dixon et al. | |
| 2003/0085963 | A1 | 5/2003 | Asakawa et al. | |
| 2006/0098049 | A1 | 5/2006 | Kanda | |
| 2006/0098054 | A1 | 5/2006 | Kanda | |
| 2009/0237466 | A1 | 9/2009 | Kanda | |
| 2010/0103221 | A1 | 4/2010 | Ohno et al. | |
| 2010/0156995 | A1 | 6/2010 | Kanda et al. | |

FOREIGN PATENT DOCUMENTS

| | | |
|---|---|---|
| JP | 08-149253 | 6/1996 |
| JP | 9-327918 | 12/1997 |
| JP | 2001-205814 | 7/2001 |
| JP | 2002-234175 | 8/2002 |
| JP | 2002-533247 | 10/2002 |
| JP | 2003-118114 | 4/2003 |

(Continued)

*Primary Examiner* — An Do
(74) *Attorney, Agent, or Firm* — Fildes & Outland, P.C.

(57) ABSTRACT

A liquid droplet ejecting head of an aspect of the invention includes: a nozzle ejecting a liquid-droplet; a liquid flow path member in which a liquid is supplied toward the nozzle; a back-pressure generating unit applying back-pressure to the liquid in a liquid-flow-path toward the nozzle; a beam member joined together with or including the liquid flow path member, deforming to become concave in a liquid-droplet ejection direction, thereafter undergoing buckling reverse deformation to become convex in the ejection direction, and applying inertia to the liquid near the nozzle in the ejection direction, to cause the liquid near the nozzle to be ejected; an opening disposed on an opposite side of the liquid flow path member in the ejection direction and communicated with the atmosphere; a suction path whose suction opening is directed toward near the nozzle; and a negative-pressure generating unit generating negative-pressure in the suction path.

11 Claims, 14 Drawing Sheets

FOREIGN PATENT DOCUMENTS

| | | |
|---|---|---|
| JP | 2003-165230 | 6/2003 |
| JP | 2003-220702 | 8/2003 |
| JP | 2004-34710 | 2/2004 |
| JP | 2005-349843 | 12/2005 |
| JP | 2006-130780 | 5/2006 |
| JP | 2006-130781 | 5/2006 |
| JP | 2006-130782 | 5/2006 |
| JP | 2006-130783 | 5/2006 |
| JP | 2007-160735 | 6/2007 |
| JP | 2008-030357 | 2/2008 |
| JP | 2008-207336 | 9/2008 |

* cited by examiner

FIG. 12

DISTANCE FROM OPENING END TO NOZZLE CENTER AND EJECTION PERFORMANCE

BACK PRESSURE SIDE (UPSTREAM)

| DISTANCE FROM NOZZLE CENTER (μm) | 25 | 50 | 75 | 100 |
|---|---|---|---|---|
| MULTIPLYING FACTOR WITH RESPECT TO NOZZLE DIAMETER | 1 | 2 | 3 | 4 |
| VISUAL DETERMINATION RESULT | ○ | ○ | △ | × |

SUCTION SIDE (DOWNSTREAM)

| DISTANCE FROM NOZZLE CENTER (μm) | 25 | 50 | 75 | 125 | 175 | 250 | 375 |
|---|---|---|---|---|---|---|---|
| MULTIPLYING FACTOR WITH RESPECT TO NOZZLE DIAMETER | 1 | 2 | 3 | 5 | 7 | 10 | 15 |
| VISUAL DETERMINATION RESULT | × | × | ○ | ○ | △ | △ | × |

LIQUID DROPLET EJECTING HEAD AND LIQUID DROPLET EJECTING APPARATUS

CROSS-REFERENCE TO RELATED APPLICATION

This application is based on and claims priority under 35 USC 119 from Japanese Patent Application No. 2008-322133 filed Dec. 18, 2008.

BACKGROUND

1. Technical Field

The present invention relates to a liquid droplet ejecting head and a liquid droplet ejecting apparatus and particularly to a liquid droplet ejecting head and a liquid droplet ejecting apparatus that eject a high-viscosity liquid as a liquid droplet.

2. Related Art

Water-based inkjet printers that are known as liquid droplet ejecting apparatus and are currently commercially available use dye-based liquids and pigment-based inks with a viscosity generally around 5 cps or 10 (or slightly larger than 10) cps at most. For reasons such as preventing liquid-bleeding when the liquid lands on a medium, increasing optical color density, suppressing expansion of the medium resulting from water content reduction and drying the medium in a short amount of time, and/or increasing the degree of freedom when totally designing such a high-quality liquid, it is known that printing performance can be improved by increasing ink viscosity.

In the ejection of the high-viscosity liquid, it is easy for problems to occur, in comparison to a low-viscosity liquid, such as the stability of the ejected liquid falls and variations in the ejected liquid droplets per nozzle increase. Particularly in a case where, counter to excessive flow path resistance of the high-viscosity liquid, back pressure is applied in order to supply the liquid to the vicinity of the nozzle, it becomes even more difficult to maintain a uniform meniscus (problem of dripping from the nozzle may also arise), and the above-described problems are promoted.

SUMMARY

A liquid droplet ejecting head of an aspect of the present invention includes: a nozzle that ejects a liquid droplet; a liquid flow path member at which a liquid flow path that supplies a liquid toward the nozzle is formed; a back pressure generating unit that applies back pressure to the liquid in the liquid flow path toward the nozzle; a beam member joined together with the liquid flow path member or including the liquid flow path member, that deforms so as to become concave in a liquid droplet ejection direction, thereafter undergoes buckling reverse deformation so as to become convex in the liquid droplet ejection direction, and applies inertia to the liquid in the vicinity of the nozzle in the ejection direction, to cause the liquid in the vicinity of the nozzle to be ejected from the nozzle as a liquid droplet; an opening that is disposed on an opposite side of the liquid flow path member to a side in the ejection direction and is communicated with the external atmosphere; a suction path whose suction opening is directed toward the vicinity of the nozzle; and a negative pressure generating unit that generates negative pressure in the suction path.

BRIEF DESCRIPTION OF THE DRAWINGS

Exemplary embodiments of the invention will be described in detail with reference to the following figures, wherein:

FIG. 12 is charts showing the relationship between a positional relationship between the opening and the nozzle and ejection performance in the liquid droplet ejecting head pertaining to the invention.

DETAILED DESCRIPTION

In FIG. 1A to FIG. 1D, there is shown the basic structure of a liquid droplet ejecting head 10 pertaining to exemplary embodiments of the invention.

Figure 1A:
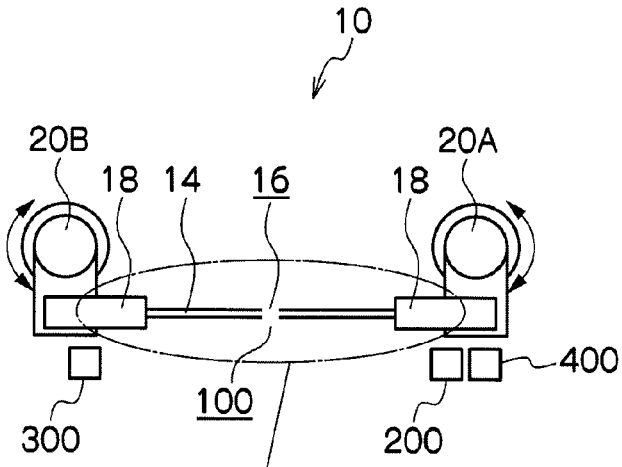
FIG. 1A is a side view showing the structure of a liquid droplet ejecting head pertaining to the invention.

The liquid droplet ejecting head 10 shown in FIG. 1A and FIG. 1B has a structure where a hollow tubular flow path member 12 having a liquid flow (supply) path 13 and a suction path 42 (mentioned later) inside and a nozzle 16 in a substantial center in its length direction and a beam member 14 that supports the flow path member 12 are joined together in a columnar shape and where support members 18 support both ends.

Further, in the left side portion of the liquid droplet ejecting head 10 with respect to the nozzle 16 in FIG. 1B (at the side of another rotary encoder 20B which will be mentioned later), a piezo element 30 is joined to the beam member 14, and a signal electrode 32 is joined to the piezo element 30, such that an actuator 36 is configured by the beam member 14, the piezo element 30 and the signal electrode 32. The beam member 14 also serves as a common electrode of the piezo element 30, and the piezo element 30 is sandwiched between the beam member 14 and the signal electrode 32. An electrode pad 33 is disposed on one end of the signal electrode 32 and is connected to an unillustrated switching IC by an unillustrated wire 34. The piezo element 30 is driven by a signal from this switching IC such that control as to whether to cause the beam member 14 to make flexure (bend) or not to make flexure (bend) is performed.

The flow path member 12 is capable of flexure in a liquid droplet ejection direction (upward in FIG. 1A and FIG. 1B) and in the opposite direction and ejects, by inertia in the ejection direction as liquid droplets, a liquid L that has been supplied from a liquid pool 24 through the liquid flow path 13 to reach the nozzle 16.

At this time, the liquid L, to which back pressure has been applied by a back pressure generating component 200, is supplied to the liquid flow path 13 from the liquid pool 24 disposed in one rotary encoder 20A, is fed from a longitudinal direction end to the vicinity of the nozzle 16, and is ejected from the nozzle 16 as liquid droplets 2.

Figure 1B:
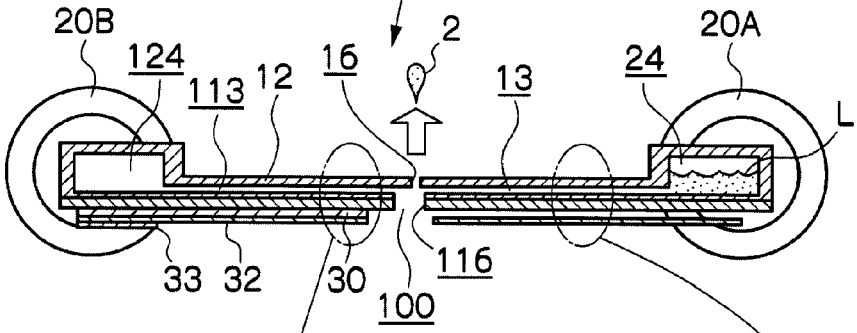
FIG. 1B is a cross-sectional view showing the structure of the liquid droplet ejecting head pertaining to the invention.
Figure 1C:
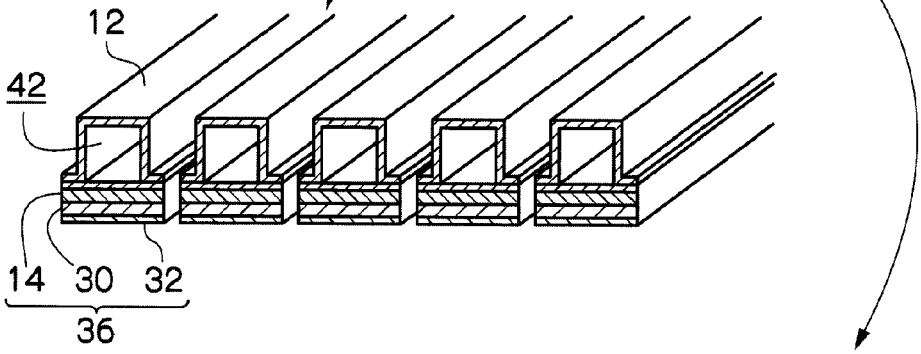
FIG. 1C and FIG. 1D are perspective views showing the structure of the liquid droplet ejecting head pertaining to the invention.

Moreover, as shown in FIG. 1B, on the opposite side of the ejection direction with respect to the nozzle 16, an opening 116 is disposed in the beam member 14 and the actuator 36, and opens to the atmosphere. Thus, the liquid L that has been fed from the liquid flow path 13 temporarily stays in a liquid pool 100 formed in the vicinity of the opening 116 disposed in the beam member 14.

As shown in FIG. 1B, a liquid suction pool 124 disposed in another rotary encoder 20B is communicated with a suction component (a negative pressure generating component 300) such that negative pressure is applied to the liquid suction pool 124. The suction path 42 is disposed in the flow path member 12 on the opposite side of the nozzle 16 with respect to the liquid flow path 13 in the longitudinal direction, and is communicated with the liquid suction pool 124. For this reason, the suction path 42 sequentially sucks out and removes the liquid L that stays in the liquid pool 100 in the vicinity of the opening 116.

Figure 1D:
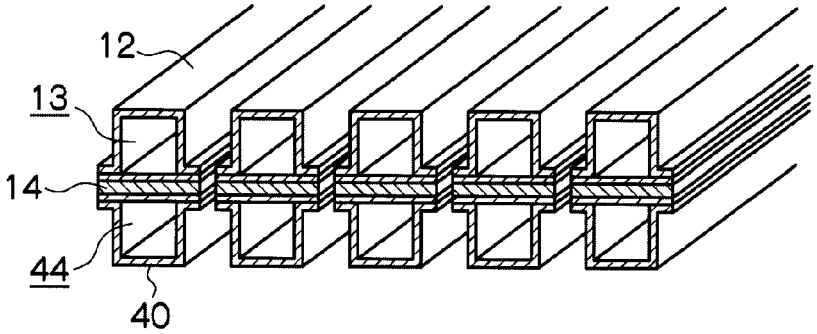

In the right side portion of the liquid droplet ejecting head 10 with respect to the nozzle 16 in FIG. 1B (at the side of the one rotary encoder 20A), as shown in FIG. 1D, a flow path member 40 is disposed on one side of the beam member 14, such as on the opposite side in the ejection direction, for example, and a blowing path 44 is formed inside the flow path member 40. The blowing path 44 is communicated with a blowing component 400 such that air that has been pressurized is fed through the blowing path 44. At this time, a filter may be disposed inside the blowing path 44 to filter the air, or a humidifying component may be disposed inside the blowing path 44 to humidify the air with solvent component of the liquid L.

The support members 18 are pressed from both sides in positions that are offset from rotation centers of the rotary encoders 20 (hereinafter, "rotary encoder 20A and rotary encoder 20B" will be merely recited as "rotary encoders 20"), or force is applied in a bend direction to the support members 18, such that the flow path member 12 that is joined to the beam member 14 is made flexure in the ink liquid ejection direction or in the opposite direction. The support members 18 may have a rod-like structure that is long in the front-to-back direction of the page surface of FIG. 1A, for example, or may have a ladder-like structure where plural flow path members 12 are disposed in the support members 18.

Further, in the case of a liquid droplet ejecting head that jets the liquid droplets 2 collectively from the plural nozzles 16, it is not necessary for the suction path 42 to be disposed for each nozzle 16; for example, one suction path 42 may be formed with respect to two nozzles 16 (liquid flow paths 13). It is not necessary for the liquid flow path 13 and the suction path 42 to have the same shape, and the suction path 42 may have a larger (fatter, wider, higher) cross section than that of the liquid flow path 13.

<Buckling Reverse Ejection>

Figure 2:
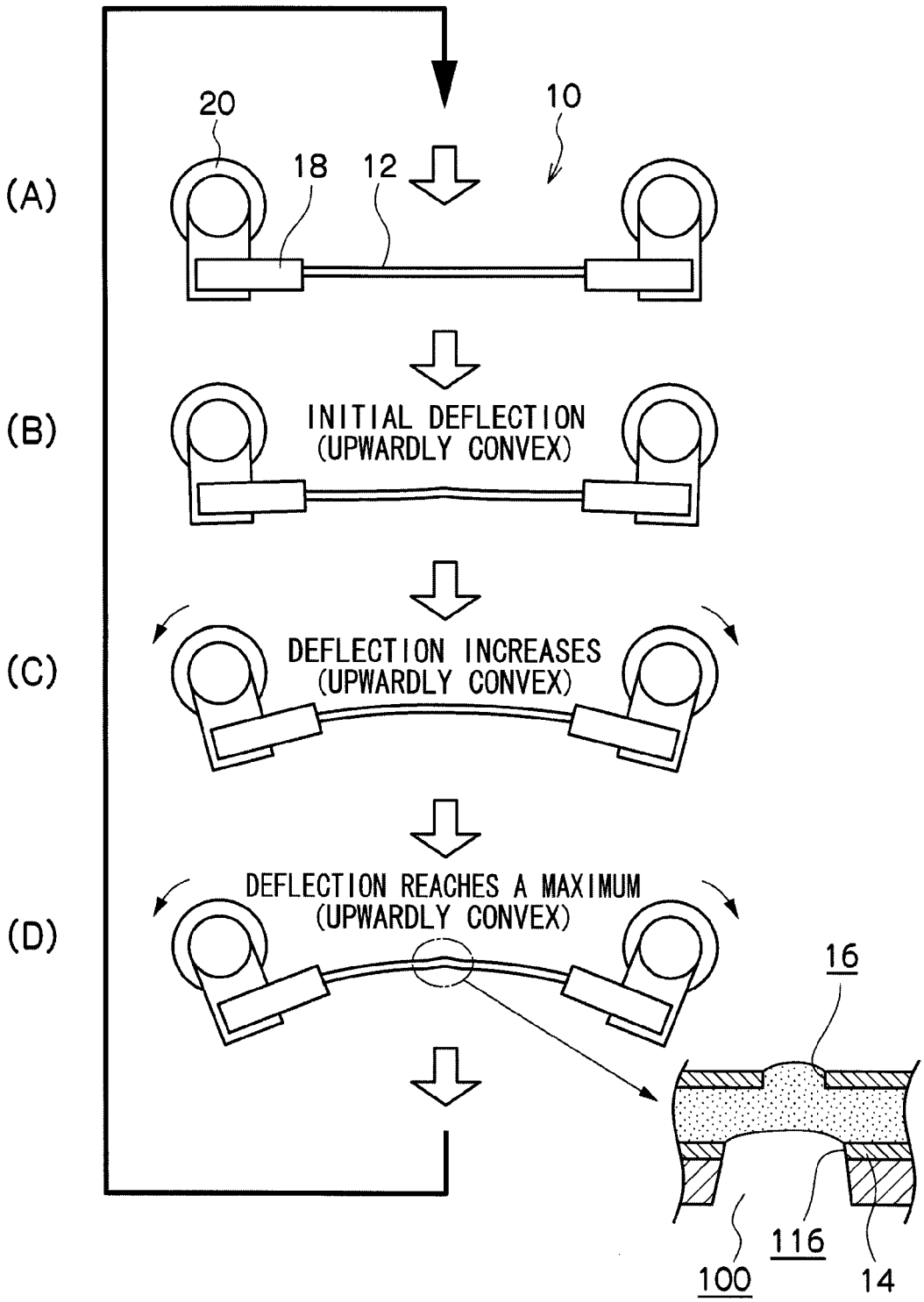
FIG. 2 is a side view showing operations of the liquid droplet ejecting head pertaining to the invention.
Figure 3:
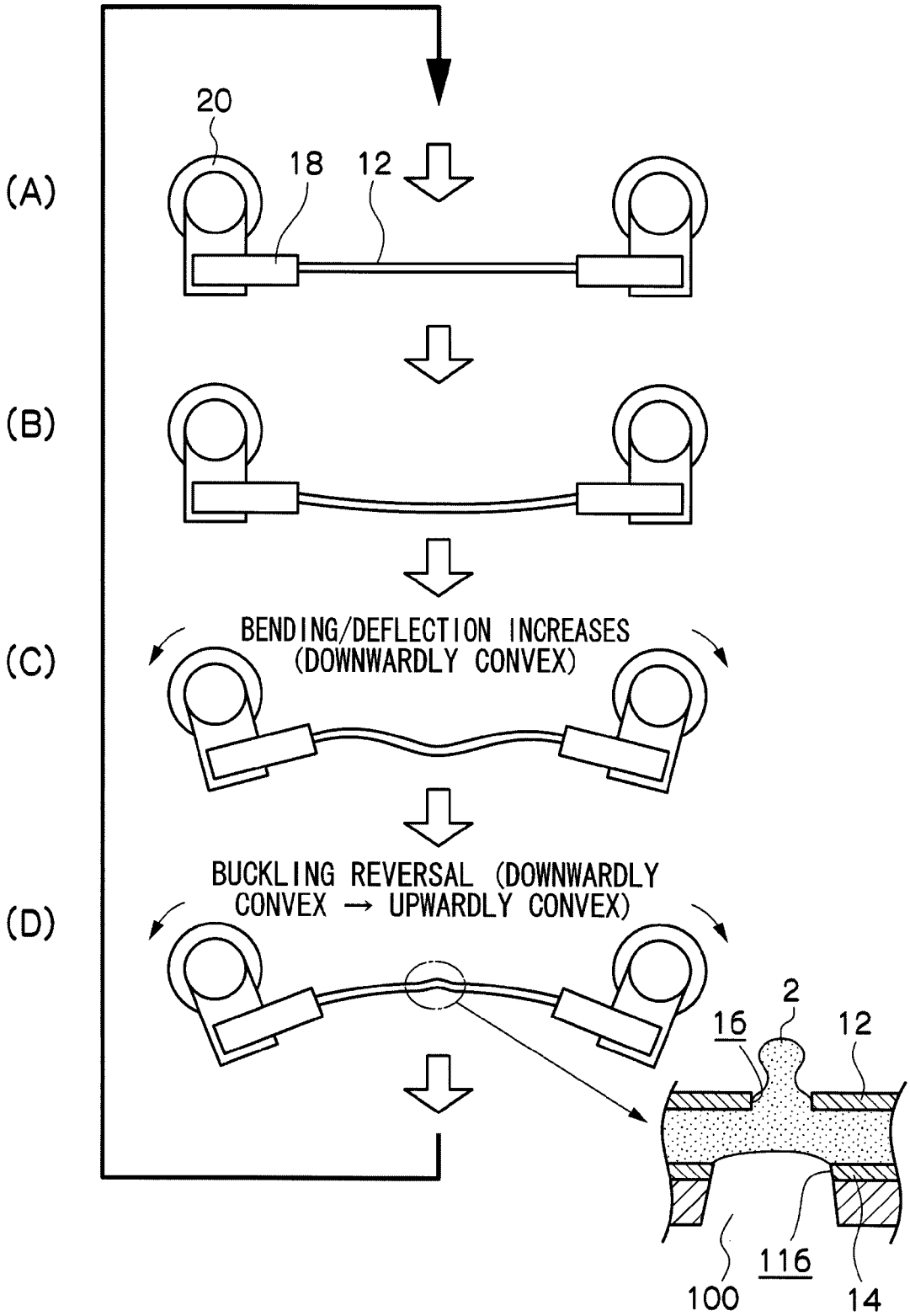
FIG. 3 is a side view showing operations of the liquid droplet ejecting head pertaining to the invention.

In FIG. 2 and FIG. 3, there is shown the relationship between buckling reverse and the flexure direction of the beam member and the flow path member of the liquid droplet ejecting head pertaining to the exemplary embodiments of the invention. All of these drawings shown deformation focusing on one flow path member in a liquid droplet ejecting head with a structure where plural flow path members are disposed in a ladder-like manner in the support members.

In a case where the liquid droplet ejecting head 10 is controlled so as to not eject the liquid droplet 2, first, as shown in (A) in FIG. 2, the rotary encoders 20 reversely rotate (rotate in the direction where they stretch the flow path member 12) such that the rotary encoders 20 straightly stretch the flow path member 12 which is in a state of having a convex shape in the ejection direction in an initial state.

Next, as shown in (B) in FIG. 2, when slackening stretching the flow path member 12, the actuator 36 is not driven because a signal instructing ejection is not sent to the flow path member 12, and the flow path member 12 remains in the state where it is made flexure so as to be convex in the ejection direction.

Further, when the rotary encoders 20 continue to be forwardly rotated in the ejection direction as shown in (C) and (D) in FIG. 2, the flexure amount increases in the state where the flow path member 12 is made flexure so as to be convex in the ejection direction, but this does not lead to ejection of the liquid droplet 2 from the nozzle 16 because deformation of the flow path member 12 in the ejection direction resulting from buckling reverse does not occur.

On the other hand, in a case where the liquid droplet ejecting head 10 is controlled so as to eject the liquid droplet 2, first, as shown in (A) in FIG. 3, the rotary encoders 20 reversely rotate (rotate in the direction where they stretch the flow path member 12) such that the rotary encoders 20 straightly stretch the flow path member 12 which is in a state of having a convex shape in the ejection direction in an initial state, and place the flow path member 12 in a state where there is no flexure.

Next, as shown in (B) in FIG. 3, a signal instructing ejection is sent to the flow path member 12 from the unillustrated switching IC, the actuator 36 is driven, and the flow path member 12 is made in a flexure state so as to be concave in the ejection direction.

Moreover, when the rotary encoders 20 are forwardly rotated in the direction of the arrows shown in (C) in FIG. 3, the flexure direction of the flow path member 12 changes, from near the rotary encoders 20 (that is, from both end sides in the longitudinal direction), such that the flow path member 12 becomes convex in the ejection direction (upward in the drawing).

When this change approaches the center from both end sides, the flow path member 12 (or the beam member 14) undergoes a steep buckling reverse at a certain point and abruptly deforms convex in the liquid droplet ejection direction (upward in the drawing) as shown in FIG. 3D.

Because the nozzle 16 is disposed in the substantial center of the flow path member 12 in the length direction of the flow path member 12, the liquid L that is supplied through the inside of the flow path member 12 and reaches the nozzle 16 is ejected as the liquid droplet 2 from the nozzle 16 in accompaniment with the convex deformation of the flow path member 12 in the ejection direction resulting from this buckling reverse.

Moreover, after the flexure amount reaches a maximum in FIG. 3D and the rotary encoders 20 stop, the rotary encoders 20 reversely rotate to flatten the flow path member 12 ((A) in FIG. 3) and thereby return the flow path member 12 to the initial position shown in (A) in FIG. 3.

Figure 4:
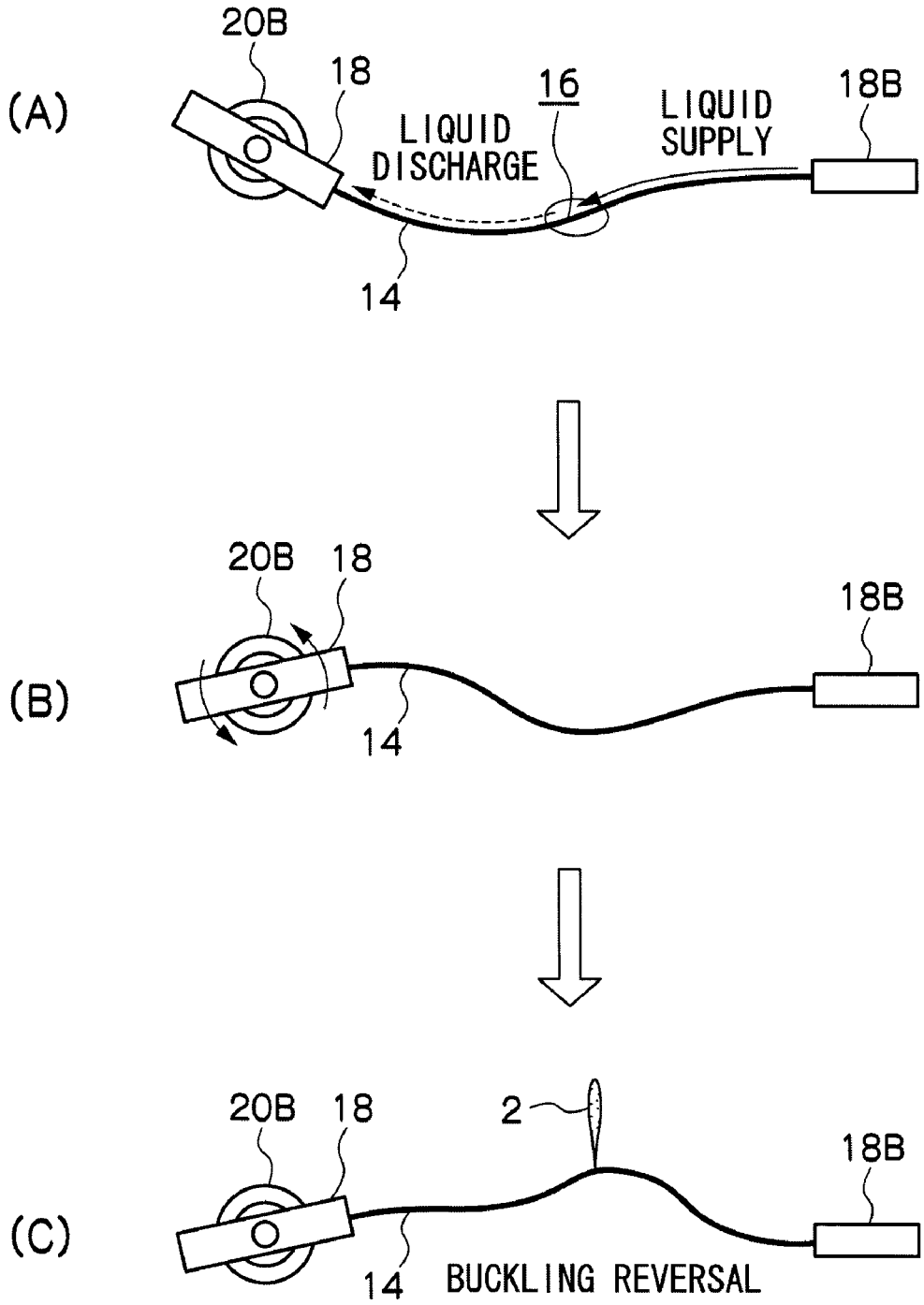
FIG. 4 is a side view showing operations of the liquid droplet ejecting head pertaining to the invention.

In FIG. 4, there is shown another structure of the liquid droplet ejecting head pertaining to the exemplary embodiment of the invention. That is, one longitudinal direction end of a beam member 14 is fixed to a support member 18 that is held in a rotary encoder 20B, and the other longitudinal direction end as a fixed end is held in a support member 18B that is fixed.

Further, a liquid flow path 13 is disposed at the support member 18B side in a flow path member 12 that is disposed on the beam member 14, a liquid L is fed toward a nozzle 16 that is disposed in the vicinity of the longitudinal direction center, and the liquid L is ejected from the nozzle 16.

As shown in (A) in FIG. 4, from an initial state where the half of the beam member 14 on the rotary encoder 20B side is concave on the ejection side and where the half of the beam member 14 on the other end side is convex on the ejection side, the liquid L is fed through the inside of the liquid flow path 13 from the end of the beam member 14 (the flow path member 12) and is fed to the nozzle 16 as shown in (A) in FIG. 4.

Moreover, as shown in (B) in FIG. 4, when the rotary encoder 20 rotates in the ejection direction, the beam member 14 begins to deform so as to become convex in the ejection direction starting from the one end of the beam member 14 that is held by the support member 18, and, as shown in (C) in FIG. 4, the portion of the beam member 14 in the vicinity of the nozzle 16 (near the center in the longitudinal direction) undergoes buckling reverse in the ejection direction, and the liquid L is ejected as the liquid droplet 2 from the nozzle 16.

Figure 5A:
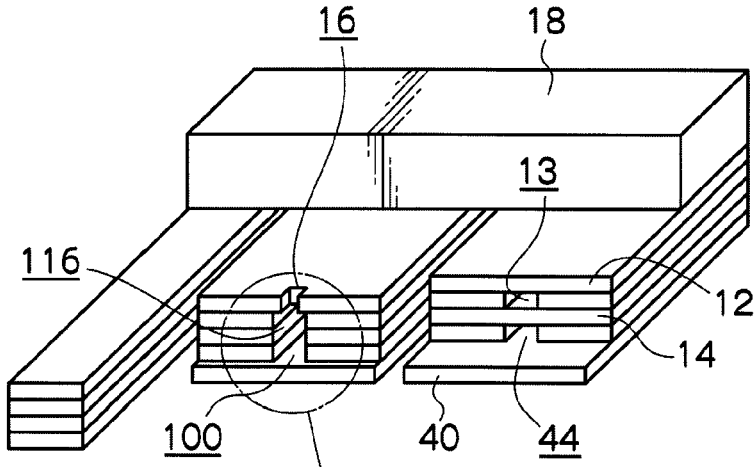
FIG. 5A is a perspective view showing the structure in the vicinity of a nozzle of the liquid droplet ejecting head pertaining to the invention.
Figure 5B:
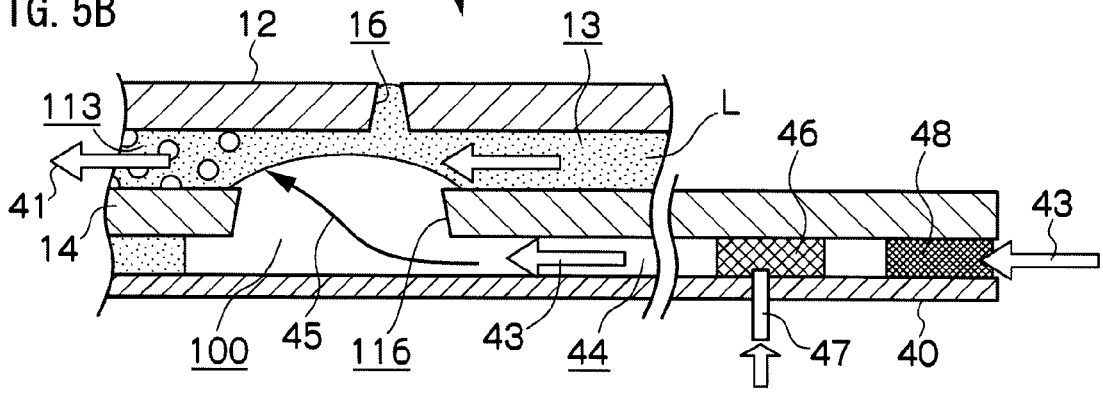
FIG. 5B is a cross-sectional view showing the structure in the vicinity of the nozzle of the liquid droplet ejecting head pertaining to the invention.

In FIG. 5A and FIG. 5B, there are shown details of the structure in the vicinity of the nozzle of the liquid droplet ejecting head pertaining to a first exemplary embodiment of the invention.

The liquid L is fed, in a state where back pressure is applied, through the inside of the liquid flow path 13 formed by the flow path member 12, so the liquid L is always supplied to the liquid pool 100 that is formed in the vicinity of the opening 16. At this time, the liquid pool 10 temporarily holds the liquid L, which is supplied in a larger quantity than the liquid quantity that is lost by ejection, so as to not become supply-deficient, and the surplus portion of the liquid L is sucked out and discharged by the suction path 113 to which negative pressure is applied. Thus, the liquid L in the pool 100 forms a free surface, shear resistance of the liquid L that obstructs inertia ejection of the liquid droplets 2 is suppressed, and the liquid droplet ejecting head is given a configuration where, in comparison to a structure where the opposite side in the ejection direction (back side of the nozzle) is tightly closed, it is difficult to be obstructed for ejection even when the liquid L has a high viscosity.

As shown in FIG. 5A and FIG. 5B, the flow path member 12 of the liquid droplet ejecting head 10 is equipped with the liquid flow path 13 that penetrates the inside of the flow path member 12 in its longitudinal direction and the nozzle 16 that is disposed in the flow path member 12, and the opening 116 that is formed by perforating the beam member 14 is disposed on the back side (opposite side in the ejection direction) of the nozzle 16.

The flow path member 40 is disposed on the opposite side of the beam member 14 in the ejection direction (the back side of the beam member 14), and the blowing path 44 is formed between the flow path member 40 and the beam member 14. The blowing path 44 is communicated with the blowing component such that air that has been pressurized is fed through the blowing path 44 as indicated by arrow 43.

A filter 48 is disposed as a filtering component inside the blowing path 44 and filters the air that is fed through the blowing path 44. Moreover, a humidifying component 46 such as a sponge that is capable of holding a liquid is disposed inside the blowing path 44 and humidifies the air that is fed through the blowing path 44 with solvent component of the liquid L. Some of the air that has been fed as indicated by arrow 43 proceeds toward the suction path 113 as indicated by arrow 45 in the liquid pool 100 and is sucked out and removed together with the surplus liquid L as indicated by arrow 41.

By configuring the liquid droplet ejecting head 10 in this manner, the liquid droplet ejecting head 10 has a configuration where, in comparison to a configuration where the liquid pool 100 merely opens to the atmosphere, there is little incorporation of dirt and foreign matter because air that has been filtered by the filter 48 is fed to the liquid pool 100 and it is difficult for the liquid L in the vicinity of the nozzle 16 to dry because air that has been humidified by solvent is fed.

Second Exemplary Embodiment

Figure 6A:
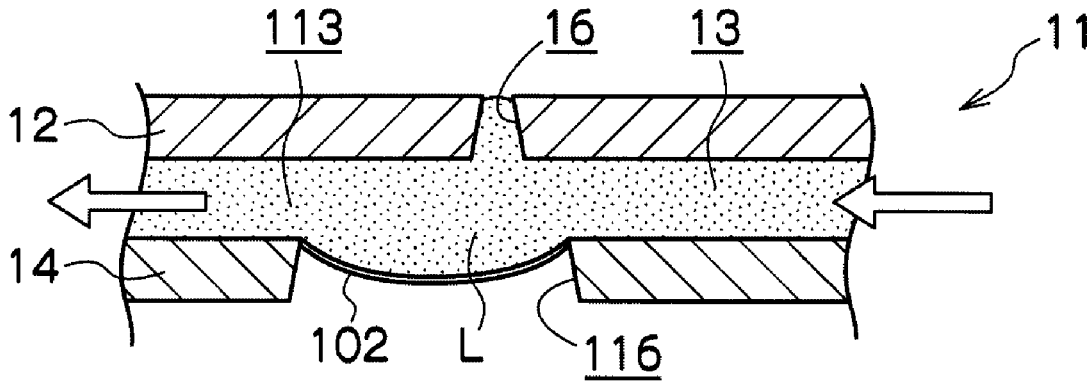
FIG. 6A and FIG. 6B are cross-sectional views showing the structure in the vicinity of the nozzle of a liquid droplet ejecting head pertaining to a second exemplary embodiment of the invention.
Figure 6B:
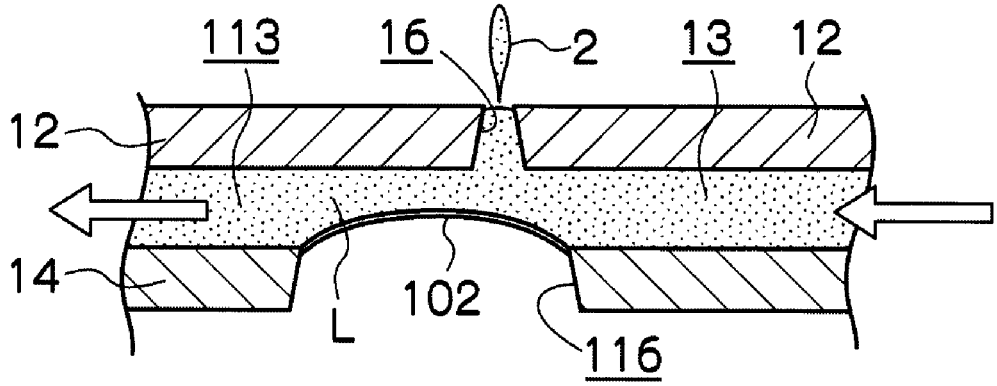

In FIG. 6A and FIG. 6B, there are shown details of the structure in the vicinity of the nozzle of a liquid droplet ejecting head 11 pertaining to a second exemplary embodiment of the invention.

The place where an opening 116 is disposed and which had been open to the atmosphere in the first exemplary embodiment is sealed by a flexible thin film 102 of a polyimide or epoxy resin with a thickness of about 5 μm, for example, such that the liquid L in a liquid pool 100 that has been formed is prevented from contacting the outside air.

That is, the opening 116 is disposed in a beam member 14 on the opposite side of the nozzle 16 in the ejection direction to form the liquid pool 100, and the opposite side of the liquid pool 100 in the ejection direction is sealed by the thin film 102, so that when the liquid L is fed, in a state where back pressure is applied, through the inside of a liquid flow path 13 formed by a flow path member 12, the thin film 102 expands as shown in FIG. 6A due to the back pressure that is applied to the liquid L.

The liquid L is always supplied to the liquid pool 100, so the liquid pool 100 that the expanded thin film 102 seals temporarily holds the liquid L, which is supplied in a larger quantity than the liquid quantity that is lost by ejection, and the surplus portion of the liquid L is sucked out and removed by a suction path 113 to which negative pressure is applied. Thus, in the liquid pool 100, a surface is formed by the flexible thin film 102, and shear resistance of the liquid L that obstructs inertia ejection of a liquid droplet 2 is suppressed.

The liquid droplet ejecting head 11 has a structure where, at the time of ejection of the liquid droplet 2, as shown in FIG. 6B, the thin film 102 deforms in the direction of the nozzle 16 (ejection direction), so it is difficult for the liquid L inside the liquid flow path 13 to be restrained. Accordingly, at the time of ejection of the liquid droplet 2, the liquid droplet ejecting head 11 has a configuration where, in comparison to a structure where the opposite side in the ejection direction (back side of the nozzle) is tightly closed by a rigid member, it is difficult to be obstructed for ejection even when the liquid L has a high viscosity.

<Manufacturing Process>

Figure 7A:
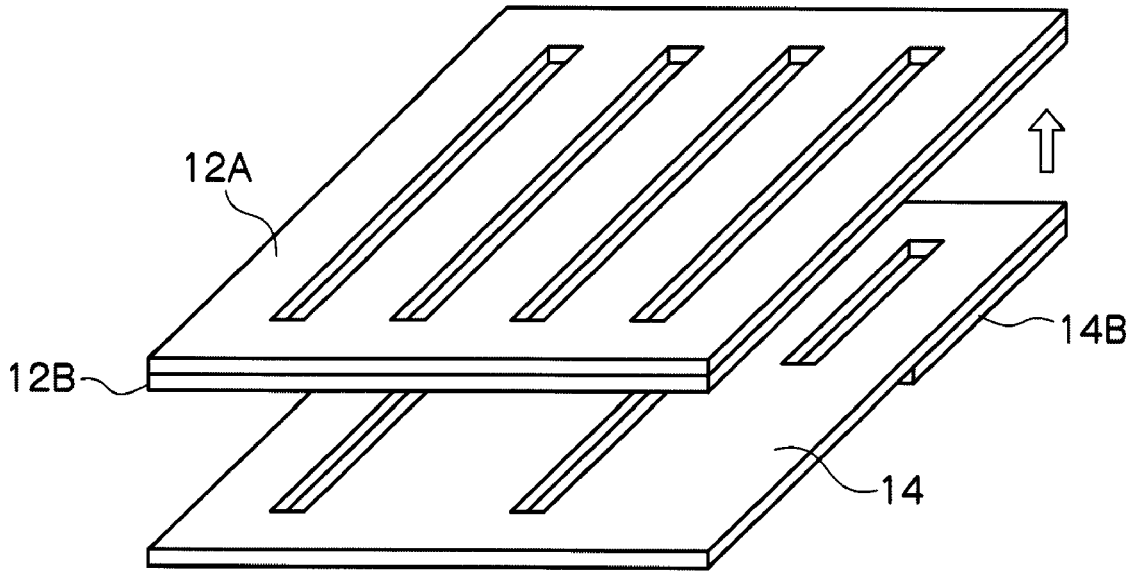
FIG. 7A to FIG. 7C are perspective views showing a process of manufacturing the liquid droplet ejecting head pertaining to the invention.
Figure 7B:
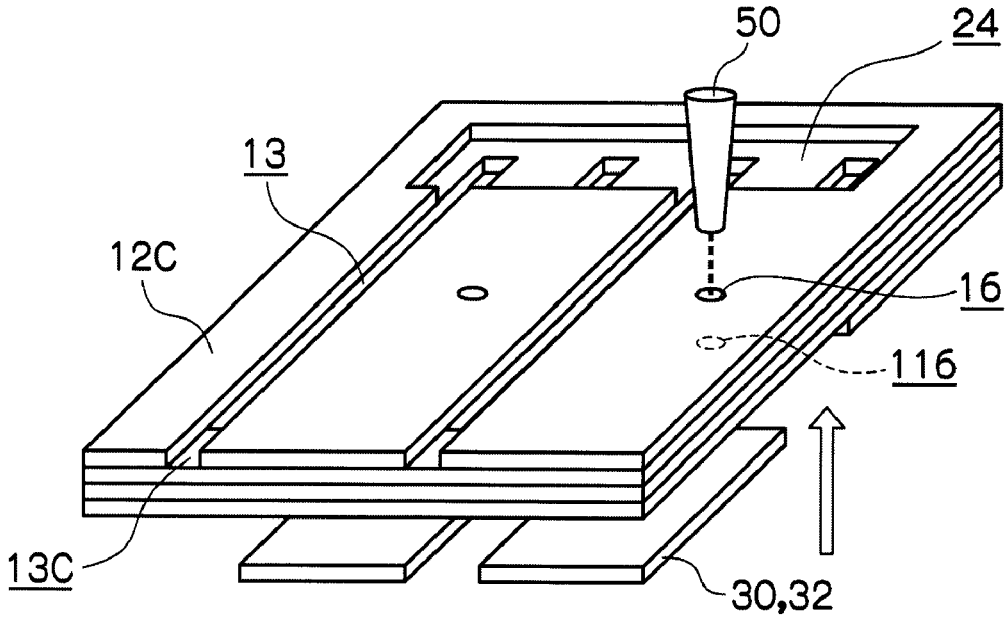
Figure 7C:
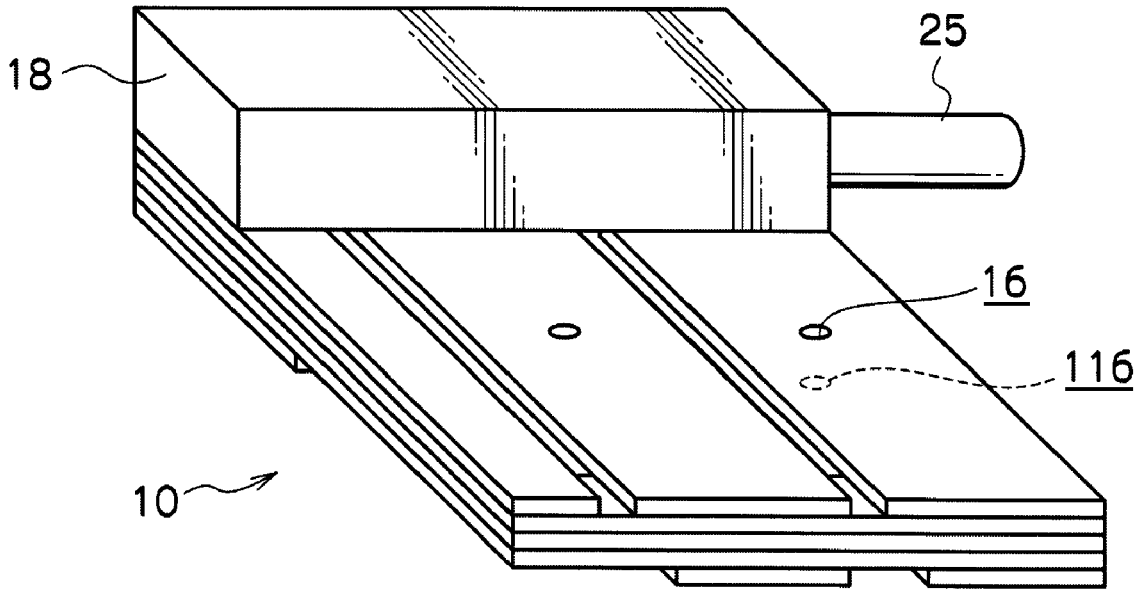

In FIG. 7A to FIG. 7C, there is shown an example of a process of manufacturing the liquid droplet ejecting head pertaining to the exemplary embodiments of the invention. First, an SUS plate with a thickness of about 20 μm is etched (slit-etched) in rows with blank therebetween with a slit width of about 70 μm, and a PI (polyimide) film 14B is heat-sealed to the ejection surface back side to form the beam member 14.

As shown in FIG. 7A, an SUS plate with a thickness of about 10 μm where a PI (polyimide) film 12B has been heat-sealed to the ejection surface back side is slit-etched with a slit width of 70 μm as a flow path member 12A. Next, the opening 116 is perforated by a YAG laser 50 or the like from the ejection surface back side to form a void (space) where the liquid pool 100 will be formed.

Next, as shown in FIG. 7B, a PI film 12C is heat-sealed to the ejection surface side of the flow path member 12A. The nozzle 16 is perforated by the YAG laser 50 or the like, and the beam member 14 that has been disposed in parallel in the longitudinal direction of the support member 18 is divided. Further, at the same time, the liquid pool 24 that communicates with the slits (=the liquid flow paths 13) that have been disposed in the flow path member 12A is disposed by removing the PI film 12C. At this time, slit-etching is performed beforehand with respect to the beam member 14 and the flow path member 12B, so just the PI film 12C on the surface is removed by laser ablation.

Moreover, the piezo elements 30 on which the signal electrodes 32 have been formed beforehand are joined in a region up to half in the longitudinal direction at the ejection back surface. A supply port 25 through which the liquid is supplied from an unillustrated liquid feed pump is connected to the liquid pool 24 disposed inside the support member 18, and the liquid droplet ejecting head 10 is formed.

Third Exemplary Embodiment

Figure 8A:
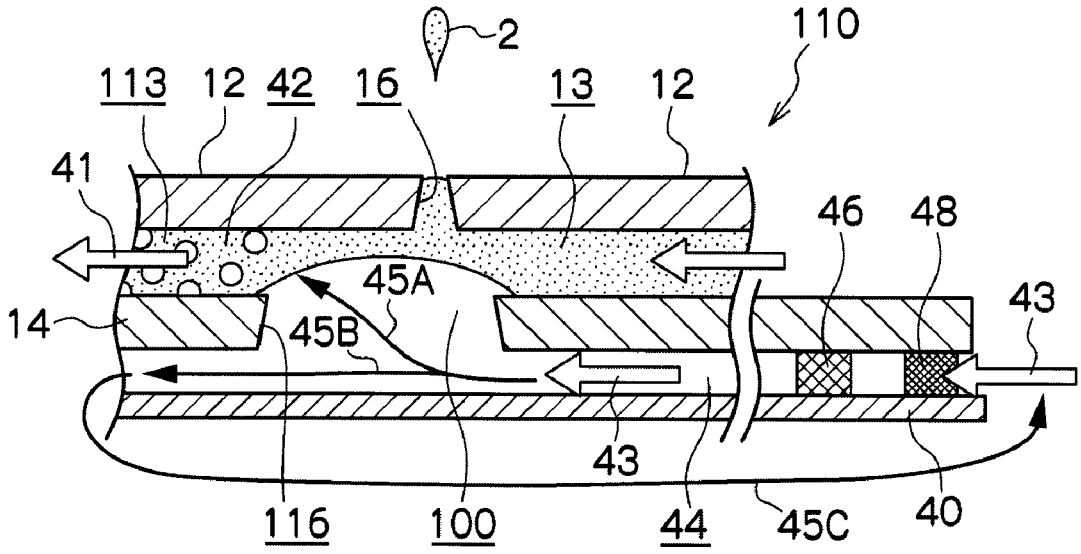
FIG. 8A is a cross-sectional view showing the structure in the vicinity of the nozzle of a liquid droplet ejecting head pertaining to a third exemplary embodiment of the invention.

In FIG. 8A, there is shown a cross-sectional view of the vicinity of a nozzle 16 of a liquid droplet ejecting head 110 pertaining to a third exemplary embodiment of the invention. In the liquid droplet ejecting head 110, a flow path member 12 is disposed on a beam member 14 whose one end is held in a support member 18, and a liquid flow path 13 is disposed in the longitudinal direction inside the flow path member 12.

As shown in FIG. 8A, the flow path member 12 of a liquid droplet ejecting head 110 is provided with the liquid flow path 13 that penetrates the inside of the flow path member 12 in its longitudinal direction and the nozzle 16 that is disposed in the flow path member 12, and an opening 116 that is formed by perforating the beam member 14 is disposed on the back side (opposite side in the ejection direction) of the nozzle 16.

A flow path member 40 is disposed on the opposite side of the beam member 14 in the ejection direction (the back side of the beam member 14), and a blowing path 44 is formed between the flow path member 40 and the beam member 14. The blowing path 44 is communicated with the blowing component such that air that has been pressurized is fed through the blowing path 44 as indicated by arrow 43.

A filter 48 is disposed as the filtering component inside the blowing path 44 and filters the air that is fed through the blowing path 44. Moreover, a humidifying component 46 such as a sponge that is capable of holding a liquid is disposed inside the blowing path 44 and humidifies the air that is fed through the blowing path 44 with solvent component of the liquid L.

The liquid flow path 13 becomes a suction path 113 after passing the nozzle 16 and is communicated with the suction component such that negative pressure is applied thereto. Some of the air that has been fed as indicated by arrow 43 proceeds toward the suction path 113 as indicated by arrow 45A in a liquid pool 100 and is sucked out and removed together with the surplus liquid L as indicated by arrow 41.

On the other hand, some of the air does not proceed from the liquid pool 100 toward the suction path 113 but is returned back to the blowing component through an air circulation path as indicated by arrow 45B. Moreover, the air is fed from the blowing component to the blowing path 44 and is again sent to the liquid pool 100 as indicated by arrow 43. By configuring the liquid droplet ejecting head 110 in this manner, the liquid droplet ejecting head 110 has a configuration where, in comparison to a configuration where the liquid pool 100 merely opens to the atmosphere, there is little incorporation of dirt and foreign matter because air that has been filtered by the filter 48 is always fed. Further, drying of the liquid in the vicinity of the nozzle 16 can be suppressed.

Fourth Exemplary Embodiment

Figure 8B:
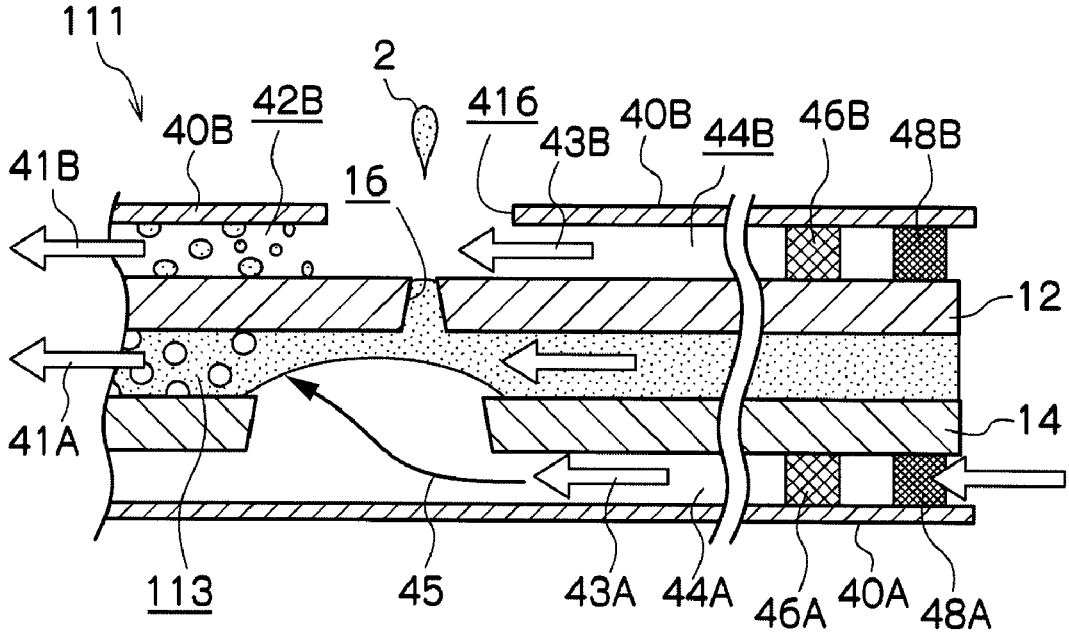
FIG. 8B is a cross-sectional view showing the structure in the vicinity of the nozzle of a liquid droplet ejecting head pertaining to a fourth exemplary embodiment of the invention.

In FIG. 8B, there is shown a cross-sectional view of the vicinity of the nozzle 16 of a liquid droplet ejecting head 111 pertaining to a fourth exemplary embodiment of the invention. In the liquid droplet ejecting head 111, a flow path member 12 is disposed on a beam member 14 whose one end is held in a support member 18, and a liquid flow path 13 is disposed in the longitudinal direction inside the flow path member 12.

As shown in FIG. 8B, the flow path member 12 of the liquid droplet ejecting head 111 is provided with the liquid flow path 13 that penetrates the inside of the flow path member 12 in the longitudinal direction and a nozzle 16 that is disposed in the flow path member 12, and an opening 116 that is formed by perforating the beam member 14 is disposed on the back side (opposite side in the ejection direction) of the nozzle 16.

A flow path member 40A is disposed on the opposite side of the beam member 14 in the ejection direction (the back side of the beam member 14), and a blowing path 44A is formed between the flow path member 40A and the beam member 14. The blowing path 44A is communicated with the blowing component such that air that has been pressurized is fed through the blowing path 44A as indicated by arrow 43A.

A filter 48A is disposed as the filtering component inside the blowing path 44A and filters the air that is fed through the blowing path 44A. Moreover, a humidifying component 46A such as a sponge that is capable of holding a liquid is disposed inside the blowing path 44A and humidifies the air that is fed through the blowing path 44A with solvent component of the liquid L.

The liquid flow path 13 becomes the suction path 113 after passing the nozzle 16 and is communicated with the suction component such that negative pressure is applied thereto. Air that has been fed as indicated by arrow 43A proceeds toward the suction path 113 as indicated by arrow 45 in a liquid pool 100 and is sucked out and removed together with the surplus liquid L as indicated by arrow 41A.

Further, a flow path member 40B is disposed on the ejection direction side of the beam member 14 (the front side of the beam member 14), and a blowing path 44B is formed between the flow path member 40B and the beam member 14. The blowing path 44B is also communicated with the blowing component such that air that has been pressurized is fed through the blowing path 44B as indicated by arrow 43B.

Moreover, a suction path 42B is formed between the flow path member 40B and the flow path member 12 on the downstream side of the nozzle 16 in the blowing direction, and the suction path 42B sucks out air that has been fed thereto. This suction path 42B is communicated with the negative pressure generating component (a suction pump or the like) such that negative pressure is applied thereto, so the suction path 42B sucks out and removes air and the liquid L that has spilled over in the ejection direction in the vicinity of the nozzle 16, as indicated by arrow 41B.

An opening 416 that is larger than the nozzle 16 as seen from the ejection direction is disposed in the flow path member 40B and does not obstruct the ejection of the liquid droplet 2 from the nozzle 16. Moreover, a filter 48B is also disposed as the filtering component inside the blowing path 44B and filters the air that is fed through the blowing path 44B. Moreover, a humidifying component 46B such as a sponge that is capable of holding a liquid is also disposed inside the blowing path 44B and humidifies the air that is fed through the blowing path 44B with solvent component of the liquid L.

By configuring the liquid droplet ejecting head 111 in this manner, the liquid droplet ejecting head 111 has a configuration where, in comparison to a configuration where the liquid pool 100 merely opens to the atmosphere, there is little incorporation of dust and foreign matter because air that has been filtered by the filter 48A is always fed, and, drying of the liquid in the vicinity of the nozzle 16 can be suppressed. Moreover, it is difficult for the liquid L to adhere in the vicinity of the nozzle 16.

Fifth Exemplary Embodiment

Figure 9A:
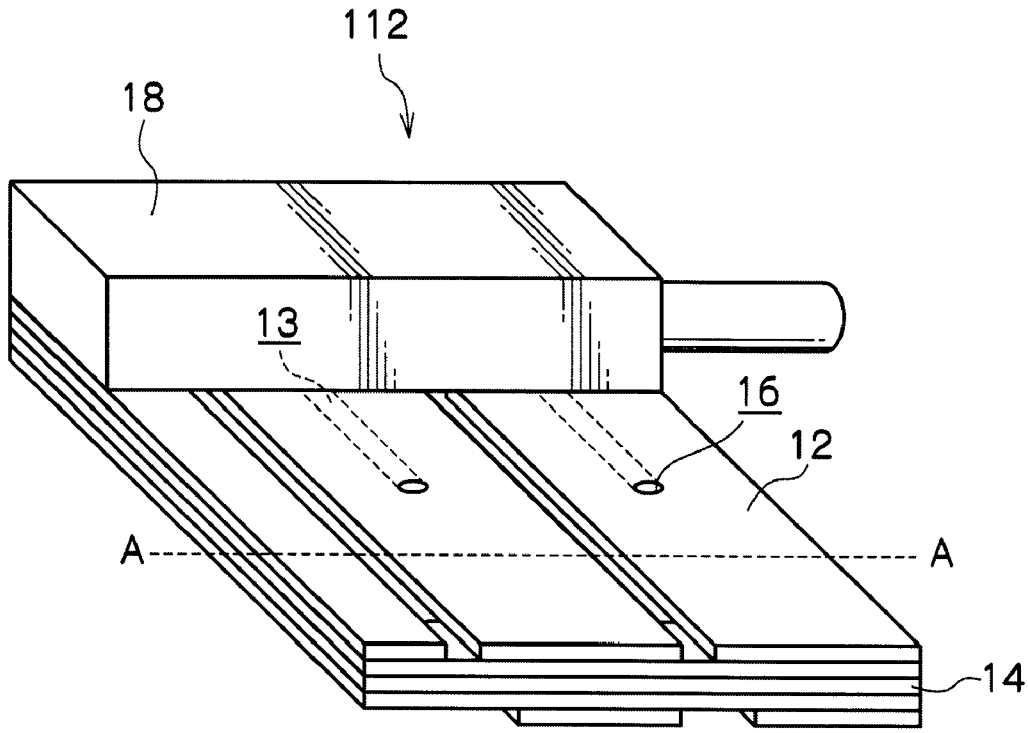
FIG. 9A and FIG. 9B are perspective views showing the structure in the vicinity of the nozzle of a liquid droplet ejecting head pertaining to a fifth exemplary embodiment of the invention.
Figure 9B:
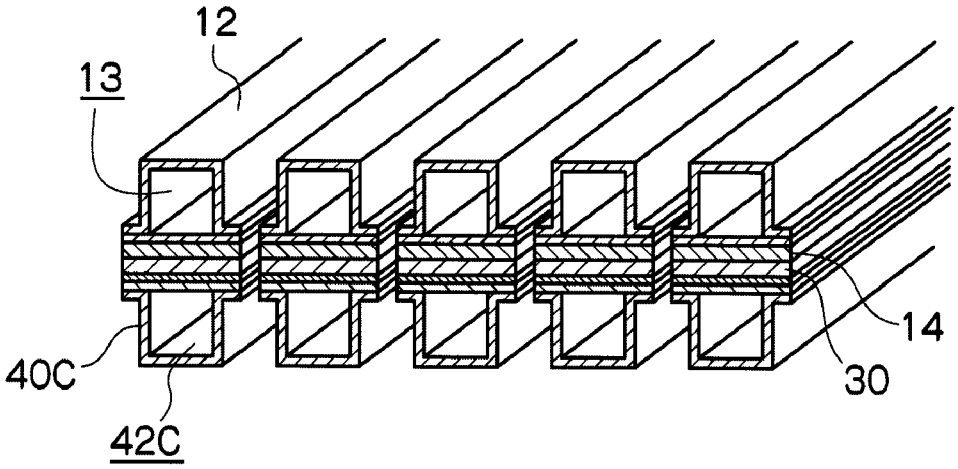

In FIG. 9A and FIG. 9B, there is shown a liquid droplet ejecting head 112 pertaining to a fifth exemplary embodiment of the invention.

The liquid droplet ejecting head 112 pertaining to the fifth exemplary embodiment of the invention has a structure where, as shown in FIG. 9A, a hollow tubular flow path member 12 having a liquid flow path 13 inside and a nozzle 16 in a substantial center in its length direction and a beam member 14 that supports the flow path member 12 are joined together in a columnar shape and where support members 18 support both ends. Further, on the opposite side of the nozzle 16 in the ejection direction, an opening 116 is disposed and a liquid pool 100 is formed in the beam member 14, which is the same as in each of the preceding exemplary embodiments.

FIG. 9B shows a cross-section along line A-A of FIG. 9A. As shown in FIG. 9B, in the liquid droplet ejecting head 112, the hollow flow path member 12 is disposed on the ejection surface side (front side) of the beam member 14, and the liquid flow path 13 is formed inside the flow path member 12. Further, a flow path member 40C is disposed on the opposite side (back side) of the ejection surface, and a suction path 42C is formed inside the flow path member 40C.

The suction path 42C is communicated with a suction component such that negative pressure is applied thereto. The suction path 42C opens in the vicinity of the liquid pool 100 that is formed on the opposite side of the nozzle 16 in the ejection direction, and the suction path 42C sucks out and removes the surplus liquid L. By configuring the liquid droplet ejecting head 112 in this manner, the liquid L can be supplied from both end sides of the liquid flow path 13 toward the nozzle 16. Further, in this configuration, when the liquid L is supplied only from one end side of the liquid flow path 13 toward the nozzle 16, the suction path 42C can be disposed on the ejection surface side (front side) and on the opposite side of the ejection surface (back side), which is superior in terms of the dischargeability of the surplus liquid L in comparison to each of the preceding exemplary embodiments.

<Opening Position>

In FIG. 10A to FIG. 10C and FIG. 11A to FIG. 11E, there are shown examples of the relationship between the liquid surface (meniscus) and the distance from the end of the opening to the center of the nozzle in the liquid droplet ejecting head pertaining to the exemplary embodiments of the invention.

Figure 10A:
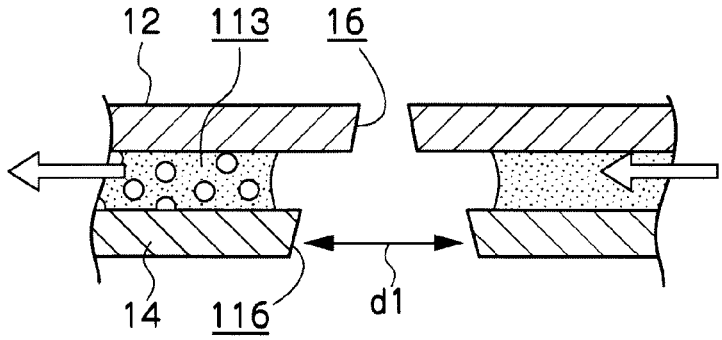
FIG. 10A to FIG. 10C are cross-sectional views showing the relationship between the size of an opening and a meniscus in the liquid droplet ejecting head pertaining to the invention.
Figure 10B:
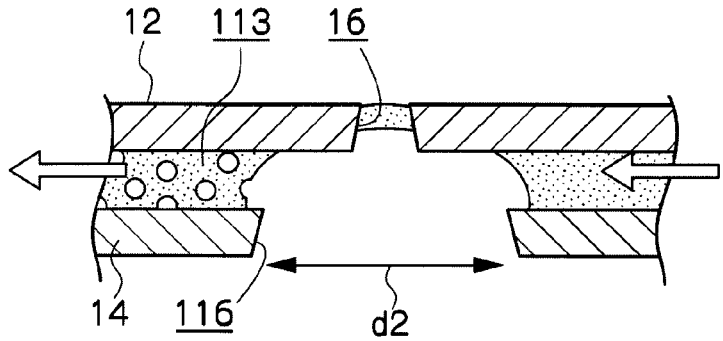
Figure 10C:
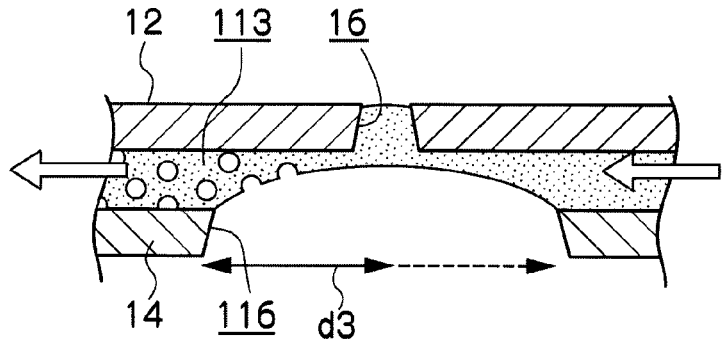

In a case where the opening size of the nozzle 16 is 50 μm, when a size d1 of the opening 116 is equal to or less than 100 μm, as shown in FIG. 10A, the liquid film in the nozzle 16 is easily destroyed and it becomes difficult for the liquid film to form. When a size d2 of the opening 116 is about 150 μm, as shown in FIG. 10B, the liquid film in the nozzle 16 is thin and becomes unstable, such as occurrence of pulsation due to suction by the suction path 113. When a size d3 of the opening 116 is about 200 to 400 μm, as shown in FIG. 10C, the problems that accompany suction described above do not arise.

Figure 11A:
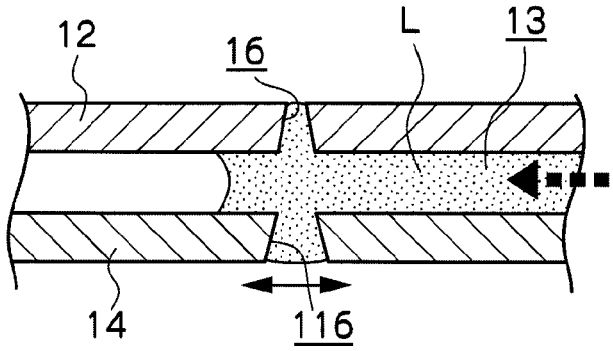
FIG. 11A to FIG. 11E are cross-sectional views showing the relationship between the size of the opening and a meniscus in the liquid droplet ejecting head pertaining to the invention.
Figure 11B:
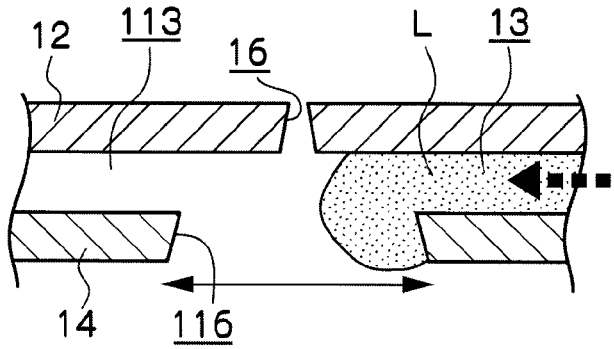

In a case where the opening diameter of the nozzle 16 is 25 μm, when suction is not performed and the liquid L is capillary-supplied without back pressure being applied thereto, there are no problems in terms of ejectability only in a case where, as shown in FIG. 11A, the size of the opening 116 is 50 μm, and when the size of the opening 116 is about 100 to 150 μm, it becomes difficult for the liquid film to be formed in the nozzle 16, such as the liquid L moves to the opening 116 and flows out as shown in FIG. 11B. Further, in a case where back pressure is applied to the liquid L and suction is performed by the suction path 113, liquid spilling, moistening, and ejection variations in the nozzles 16 occur regardless of the size of the opening 116.

Figure 11C:
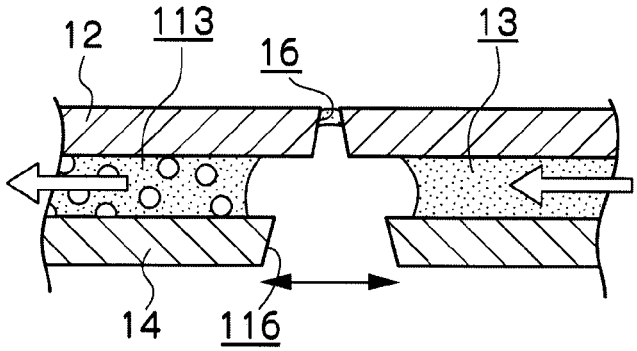

In a case where back pressure is applied to the liquid L and suction is performed by the suction path 113, when the size of the opening 116 is equal to or less than 100 μm, as shown in FIG. 11C, it becomes easy for the liquid film in the nozzle 16 to be destroyed by suction from the suction path 113 and ejection variations occur.

Figure 11D:
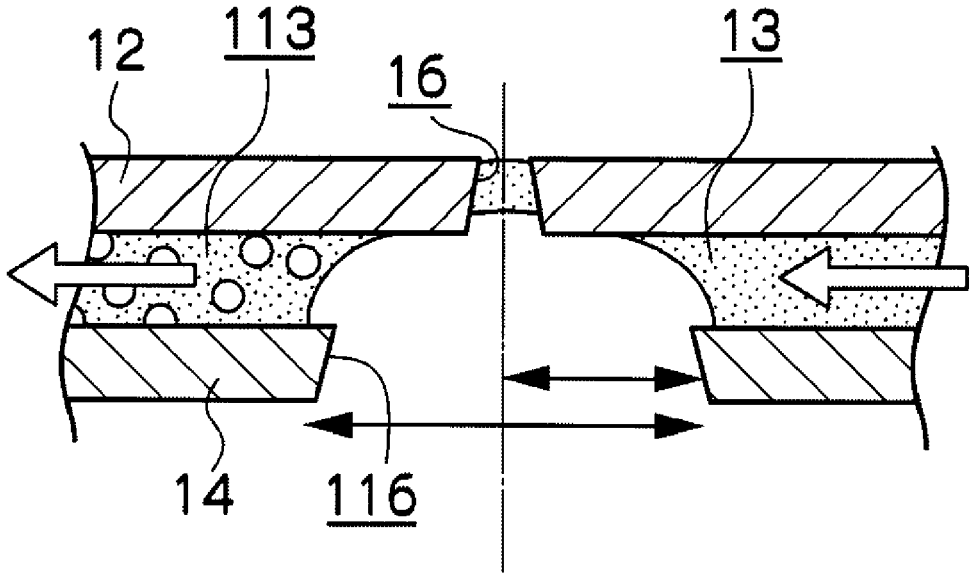
Figure 11E:
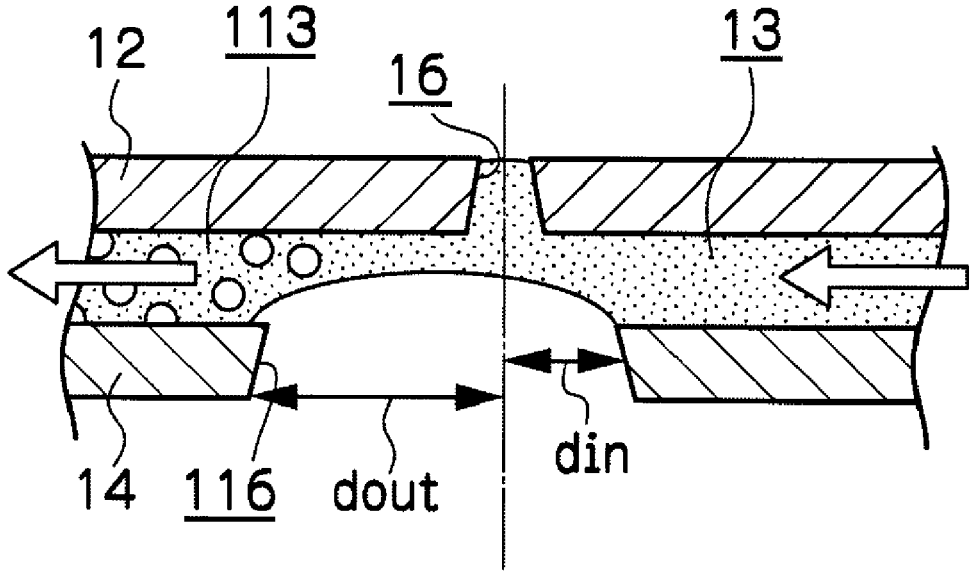

When the size of the opening 116 is about 150 μm, as shown in FIG. 11D, the liquid film in the nozzle 16 becomes thin and it becomes difficult to maintain the liquid film because the distance from the liquid flow path 13 becomes large, and ejection variations occur. The above-described examples are all results of cases where the centers of the nozzle 16 and the opening 116 coincide as seen from the ejection direction. In this cases where the centers of the nozzle 16 and the opening 116 coincide, it is difficult to obtain sizes of the opening 116 and the nozzle 16 such that proper nozzle ejection performance and the like is obtained.

Thus, the charts in FIG. 12 show results where the distance (d in) from the back pressure side (supply side) end of the opening 116 to the center of the nozzle 16 and the distance (d out) from the suction side (downstream side) end of the opening 116 to the center of the nozzle 16 are varied and ejection performance is visually determined.

As shown in FIG. 12, ejection performance is excellent when the distance from the back pressure side (supply side) of the opening 116 to the center of the nozzle 16 is within 3 times the diameter of the nozzle 16, and ejection performance is excellent when the distance from the suction side (downstream side) end of the opening 116 to the center of the nozzle 16 is in the range of 3 times to 10 times the diameter of the nozzle 16.

<Other>

The present invention is not limited to the preceding exemplary embodiments. For example, in each of the preceding exemplary embodiments, there has been exemplified a configuration where the suction path 113 and the blowing path 44 are disposed for each of the nozzles 16, but the present invention is not limited to this and may also be configured such that the suction path 113 and the blowing path 44 are disposed for each plurality (e.g., two or four) of the nozzles 16. At this time, as long as the nozzles 16 are disposed evenly with respect to the suction path 113 and the blowing path 44, it is easy for the liquid film to be made uniform.

Further, the liquid droplet ejecting head in the exemplary embodiments has been described by way of an inkjet recording head, but the liquid droplet ejecting head is not invariably limited to recording characters and images on recording paper using ink. That is, the recording medium is not limited to paper, and the liquid that is ejected is also not limited to ink. For example, it is possible to apply the present invention to all liquid droplet jetting apparatus that are used for industrial purposes, such as apparatus that eject a liquid onto polymer film or glass to create color filters for displays or apparatus that eject liquid-solder onto a substrate to form bumps for mounting parts.

What is claimed is:

1. A liquid droplet ejecting head comprising:

a nozzle that ejects a liquid droplet;

a liquid flow path member at which a liquid flow path that supplies a liquid toward the nozzle is formed;

a back pressure generating unit that applies back pressure to the liquid in the liquid flow path toward the nozzle;

a beam member joined together with the liquid flow path member or including the liquid flow path member, that deforms so as to become concave in a liquid droplet ejection direction, thereafter undergoes buckling reverse deformation so as to become convex in the liquid droplet ejection direction, and applies inertia to the liquid in the vicinity of the nozzle in the ejection direction, to cause the liquid in the vicinity of the nozzle to be ejected from the nozzle as a liquid droplet;

an opening that is disposed on an opposite side of the liquid flow path member to a side in the ejection direction and is communicated with the external atmosphere;

a suction path whose suction opening is directed toward the vicinity of the nozzle; and a negative pressure generating unit that generates negative pressure in the suction path;

wherein, as seen from the ejection direction, a center of the opening is offset toward the suction path from a center of the nozzle, a distance from the center of the nozzle to an end of the opening at a suction path side is in a range from 3 times to 10 times the diameter of the nozzle, and a distance from the center of the nozzle to an end of the opening at the farthest side from the suction path is in a range of equal to or less than 3 times the diameter of the nozzle.

2. The liquid droplet ejecting head of claim 1, wherein the opening is sealed by a flexible film that is thinner than the thickness in the ejection direction of the liquid flow path member.

3. The liquid droplet ejecting head of claim 1, further comprising:

a blowing path that blows air toward the suction opening of the suction path, and a blowing unit that generates positive pressure in the blowing path.

4. The liquid droplet ejecting head of claim 3, further comprising a humidifying unit that adds a solvent of the liquid to the air.

5. The liquid droplet ejecting head of claim 3, further comprising a filtering unit disposed in the blowing path that filters the air.

6. The liquid droplet ejecting head of claim 1, wherein the blowing path is provided on an opposite side of the beam member to a side in the ejection direction.

7. The liquid droplet ejecting head of claim 6, wherein a second blowing path is provided on the side of the liquid flow path member in the ejection direction.

8. The liquid droplet ejecting head of claim 1, wherein the blowing path is communicated with an air circulation path via the opening, and the air through the air circulation path is fed to the blowing unit.

9. A liquid droplet ejecting head comprising:

a nozzle that ejects a liquid droplet;

a liquid flow path member at which a liquid flow path that supplies a liquid toward the nozzle is formed;

a back pressure generating unit that applies back pressure to the liquid in the liquid flow path toward the nozzle;

a beam member joined together with the liquid flow path member or including the liquid flow path member, that deforms so as to become concave in a liquid droplet ejection direction, thereafter undergoes buckling reverse deformation so as to become convex in the liquid droplet ejection direction, and applies inertia to the liquid in the vicinity of the nozzle in the ejection direction, to cause the liquid in the vicinity of the nozzle to be ejected from the nozzle as a liquid droplet;

an opening that is communicated with the nozzle and is disposed on an opposite side of the liquid flow path member to a side in the ejection direction and is communicated with the external atmosphere;

a suction path that is formed at the liquid flow path member and whose suction opening is directed toward the vicinity of the nozzle, the suction path sucking the liquid;

a negative pressure generating unit that generates negative pressure in the suction path; and a flexible film that seals the opening and is thinner than the thickness in the ejection direction of the liquid flow path member;

wherein, as seen from the ejection direction, a center of the opening is offset toward the suction path from a center of the nozzle, a distance from the center of the nozzle to an end of the opening at a suction path side is in a range from 3 times to 10 times the diameter of the nozzle, and a distance from the center of the nozzle to an end of the opening at the farthest side from the suction path is in a range of equal to or less than 3 times the diameter of the nozzle.

10. A liquid droplet ejecting head comprising:

a nozzle that ejects a liquid droplet;

a liquid flow path member at which a liquid flow path that supplies a liquid toward the nozzle is formed;

a back pressure generating unit that applies back pressure to the liquid in the liquid flow path toward the nozzle;

a beam member joined together with the liquid flow path member or including the liquid flow path member, that deforms so as to become concave in a liquid droplet ejection direction, thereafter undergoes buckling reverse deformation so as to become convex in the liquid droplet ejection direction, and applies inertia to the liquid in the vicinity of the nozzle in the ejection direction, to cause the liquid in the vicinity of the nozzle to be ejected from the nozzle as a liquid droplet;

an opening that is communicated with the nozzle and is disposed on an opposite side of the liquid flow path member to a side in the ejection direction and is communicated with the external atmosphere;

a suction path that is formed at the liquid flow path member and whose suction opening is directed toward the vicinity of the nozzle, the suction path sucking the liquid;

a negative pressure generating unit that generates negative pressure in the suction path;

a blowing path that blows air toward the suction opening of the suction path; and a blowing unit that generates positive pressure in the blowing path;

wherein, as seen from the election direction, a center of the opening is offset toward the suction path from a center of the nozzle, a distance from the center of the nozzle to an end of the opening at a suction path side is in a range from 3 times to 10 times the diameter of the nozzle, and a distance from the center of the nozzle to an end of the opening at the farthest side from the suction path is in a range of equal to or less than 3 times the diameter of the nozzle.

11. A liquid droplet ejecting apparatus comprising a liquid droplet ejecting head including:

a nozzle that ejects a liquid droplet;

a liquid flow path member at which a liquid flow path that supplies a liquid toward the nozzle is formed;

a back pressure generating unit that applies back pressure to the liquid in the liquid flow path toward the nozzle;

a beam member joined together with the liquid flow path member or including the liquid flow path member, that deforms so as to become concave in a liquid droplet ejection direction, thereafter undergoes buckling reverse deformation so as to become convex in the liquid droplet ejection direction, and applies inertia to the liquid in the vicinity of the nozzle in the ejection direction, to cause the liquid in the vicinity of the nozzle to be ejected from the nozzle as a liquid droplet;

an opening that is disposed on an opposite side of the liquid flow path member to a side in the ejection direction and is communicated with the external atmosphere;

a suction path whose suction opening is directed toward the vicinity of the nozzle; and a negative pressure generating unit that generates negative pressure in the suction path;

wherein, as seen from the ejection direction, a center of the opening is offset toward the suction path from a center of the nozzle, a distance from the center of the nozzle to an end of the opening at a suction path side is in a range from 3 times to 10 times the diameter of the nozzle, and a distance from the center of the nozzle to an end of the opening at the farthest side from the suction path is in a range of equal to or less than 3 times the diameter of the nozzle.

* * * * *